United States Patent [19]

Suwabe et al.

[11] 4,409,058

[45] Oct. 11, 1983

[54] BAND TYPE STRAPPING MACHINE

[75] Inventors: Isaku Suwabe, Mishima; Motoaki Mori, Yokohama, both of Japan

[73] Assignee: Nichiro Kogyo Company, Ltd., Yokohama, Japan

[21] Appl. No.: 349,461

[22] Filed: Feb. 17, 1982

[30] Foreign Application Priority Data

Oct. 7, 1981 [JP] Japan ..... 56-149333[U]

[51] Int. Cl.[3] ..... B32B 31/00

[52] U.S. Cl. ..... 156/361; 100/33 PB; 156/580

[58] Field of Search ..... 156/494, 510, 515, 580, 156/583.1, 73.5, 378, 361; 100/33 PB, 33 N

[56] References Cited

U.S. PATENT DOCUMENTS

| | | | |
|---|---|---|---|
| 3,269,300 | 8/1966 | Billett et al. | 100/8 |
| 3,438,833 | 4/1969 | Nakano | 156/502 |
| 3,442,203 | 5/1969 | Kobiella | 100/33 N X |
| 4,313,779 | 2/1982 | Nix | 100/33 PB X |

*Primary Examiner*—David A. Simmons

*Attorney, Agent, or Firm*—Oblon, Fisher, Spivak, McClelland & Maier

[57] ABSTRACT

A band type strapping machine comprises a feeding and tightening roller driven by a motor, an auxiliary roller in contact with the feeding and tightening roller, a cam shaft which is rotated by the motor through a reduction gear and a clutch mechanism and which has cams for respectively actuating a rear gripper, a heater, a press bar and a front gripper, wherein the motor is capable of instantaneous change of normal and reverse rotations and has a large starting torque, and an electromagnetic clutch is fitted to the rotary shaft of the tightening and feeding roller so as to be movable in the axial direction depending upon increase of a band tightening force whereby detection of the tightening force caused by the movement of the electromagnetic clutch is mechanically related to the engagement or disengagement of the clutch mechanism.

5 Claims, 10 Drawing Figures

BAND TYPE STRAPPING MACHINE

BACKGROUND OF THE INVENTION

1. Field of the Invention

The present invention relates to a band type strapping machine. More particularly, it relates to a band type strapping machine capable of a series of automatic operations of feeding, tightening, heat-bonding and cutting a band.

2. Description of the Prior Art

It has been known to use a band type strapping machine in which the feeding and tightening of a band is performed by selectively contacting a rocker roller to either one of two rollers which are independently driven in opposite directions to each other. This strapping machine requires a special electromagnetic braking mechanism whereby the size of the machine is large and the structure is complicated resulting in a high manufacturing cost.

In order to eliminate the electromagnetic braking mechanism for the rocker roller, a reversible motor has been used to feed or tighten the band. In the conventional strapping machine using the reversible motor, however, the instantaneous reversing operation of the motor and the operations of various parts in association with the operation of the motor is not satisfactory and automatic feeding and tightening operations for the band could not be performed with high accuracy and efficiency.

SUMMARY OF THE INVENTION

It is an object of the present invention to provide an improved strapping machine having a simple structure while increasing the function to attain an automatic band bonding operation with high efficiency.

The foregoing and the other objects of the present invention have been attained by providing a band type strapping machine comprising a feeding and tightening roller driven by a motor, an auxiliary roller in contact with the feeding and tightening roller, a cam shaft which is rotated by the motor through a reduction gear and a clutch mechanism and which has cams for respectively actuating a rear gripper, a heater, a press bar and a front gripper, wherein the motor is capable of instantaneous change of normal and reverse rotations and has a large starting torque and an electromagnetic clutch is fitted to the rotary shaft of the tightening and feeding roller so as to be movable in the axial direction depending upon increase of a band tightening force whereby detection of the tightening force caused by the movement of the electromagnetic clutch is mechanically related to the engagement or disengagement of the clutch mechanism.

BRIEF DESCRIPTION OF DRAWINGS

FIGS. 6 to 8 are respectively schematic views showing operation of the clutch in which FIG. 6 illustrates a state of the clutch connected; FIG. 7 a disconnecting state and FIG. 8 a state of a complete disconnection;

DETAILED DESCRIPTION OF PREFERRED EMBODIMENT

An embodiment of the band type strapping machine of the present invention will be described with reference to FIGS. 1 to 10.

The character (M) designates a motor which is of an instantaneous reversible rotation type and operates on a single phase AC 100 V or 200 V and is capable of instantaneous change of normal and reverse rotations without using an electromagnetic brake.

Figure 3:
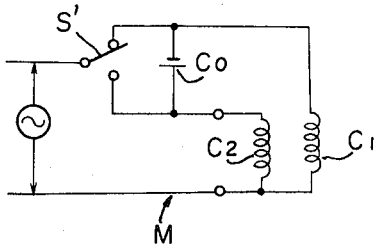
FIG. 3 is a circuit diagram of a motor used in the present invention.
Figure 9:
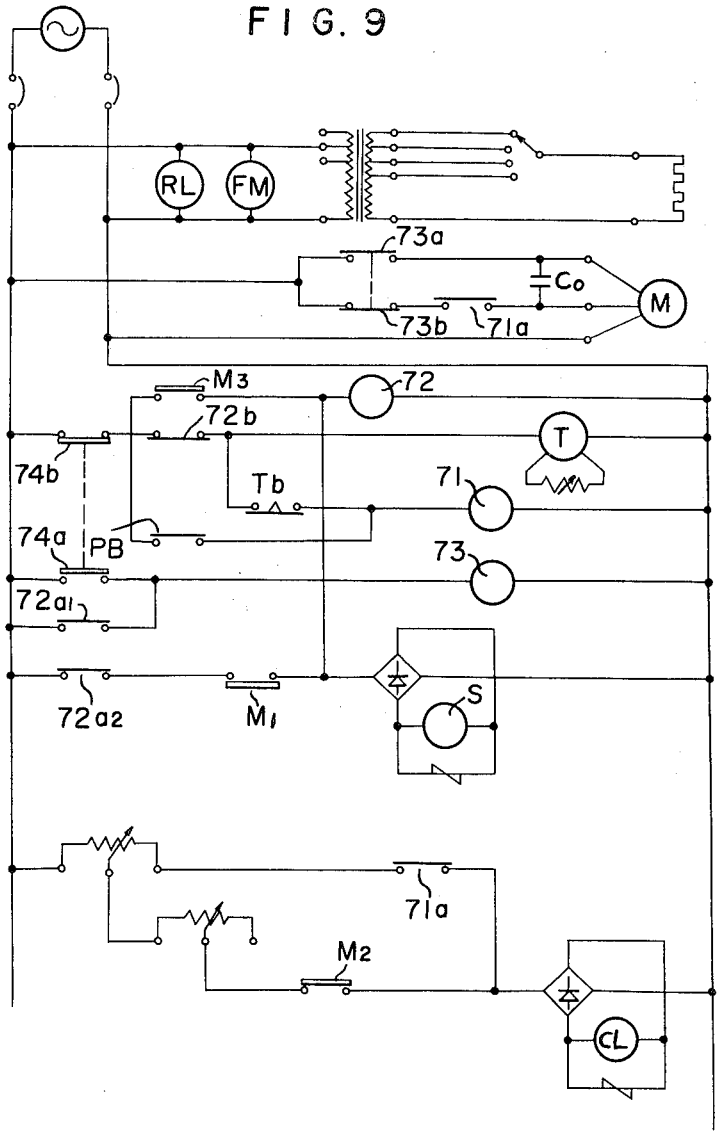
FIG. 9 is a circuit diagram of an embodiment of the band type strapping machine of the present invention.
Figure 10:
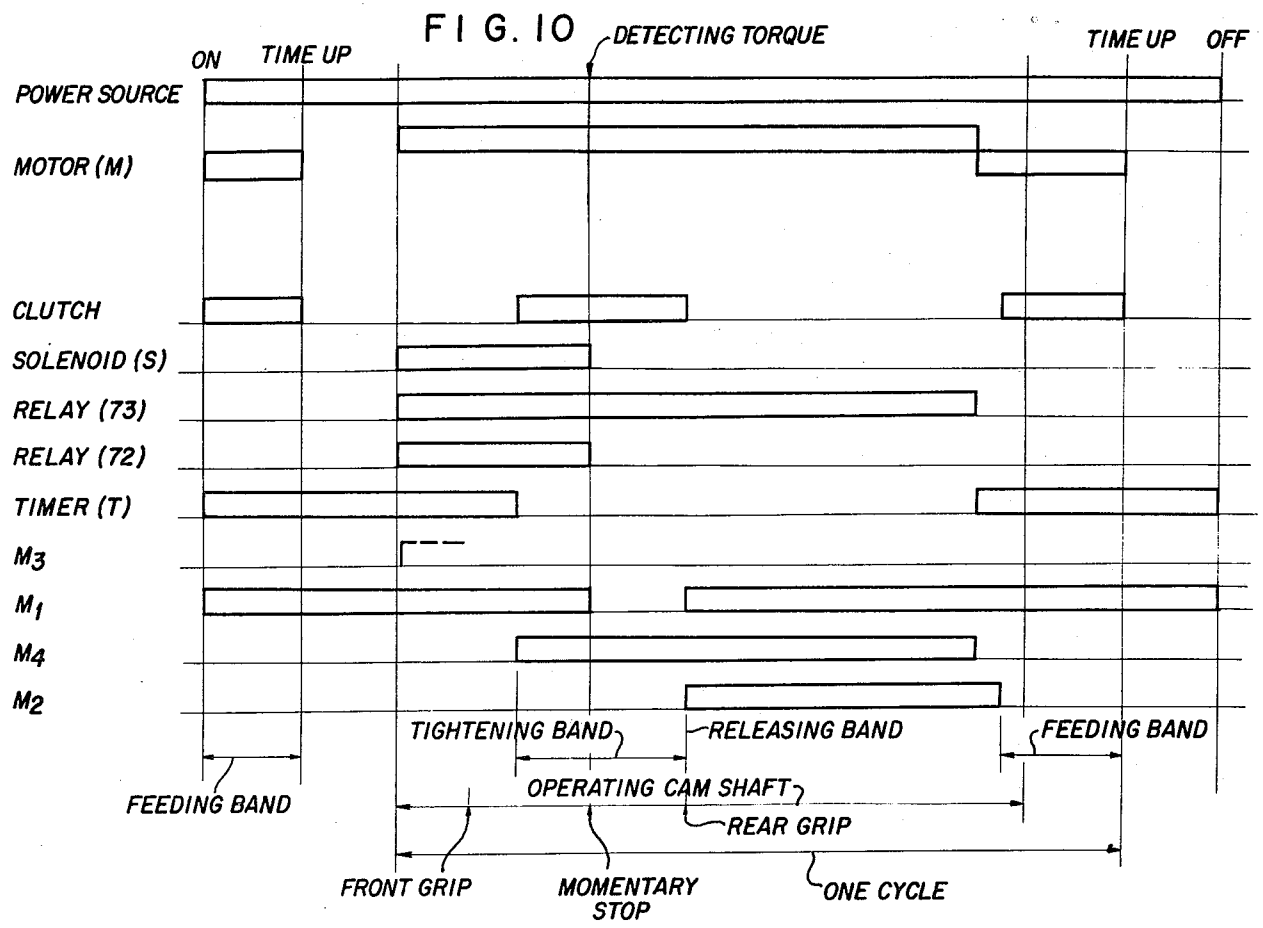
FIG. 10 is a time chart showing the operation of the strapping machine of the present invention.

Description will be made with reference to FIGS. 3 and 9. The character ($C_1$) designates a main coil, ($C_2$) designates an auxiliary coil, both the coils having the same diameter of the wire and number of turn and being connected in parallel, and (S') designates a changing switch for switching the rotation of the motor in normal or reverse direction, said switch comprising the contact (71*a*) of a relay (71) and the contacts (73*a*), (73*b*) of a relay (73). ($C_0$) designates a capacitor having a capacitance greater than that of the conventional one used in a capacitor motor whereby a large current can be supplied to attain a large motive force at the time of switching the main coil ($C_1$) and the auxiliary coil ($C_2$).

Figure 1:
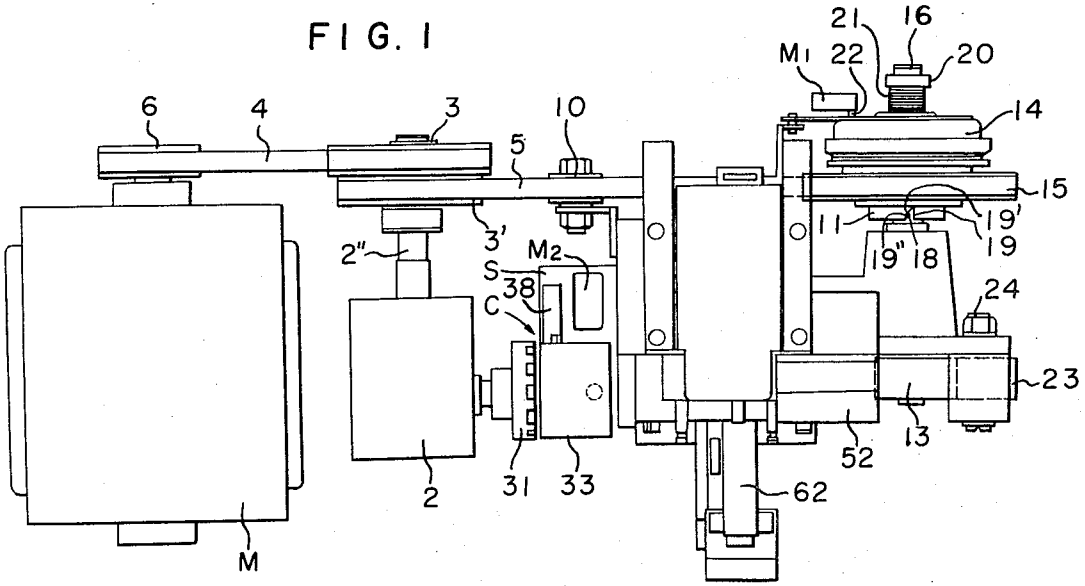
FIG. 1 is a front view of an embodiment of the band type strapping machine.
Figure 2:
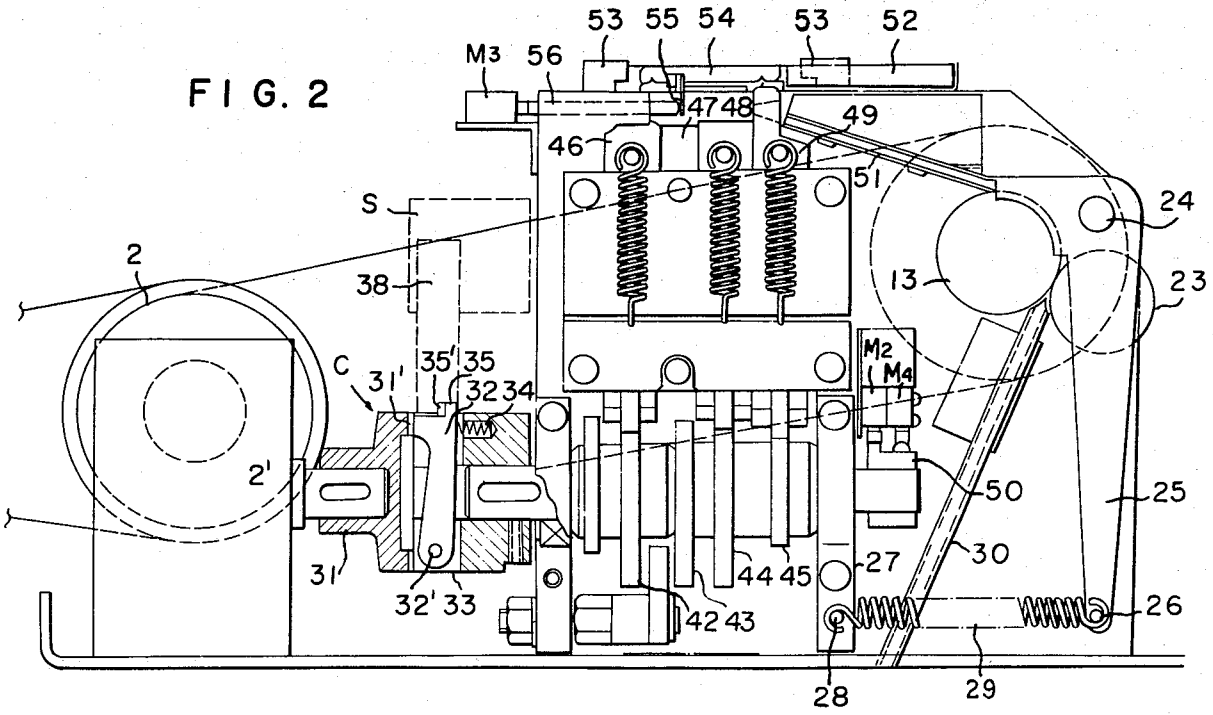
FIG. 2 is a longitudinal sectional view of the machine.

In FIGS. 1 and 2, the reference numeral (2) designates a reduction gear having an input shaft (2'') to which a driving force of the motor (M) is transmitted through a pulley (6), a belt (4) and a double pulley (3).

A belt (5) is wound around the small diametric pulley (3') of the double pulley (3) and a pulley (15) which is connected to an electromagnetic clutch (14) when actuated. (10) designates an idler pulley for adjusting tension of the belt (5). (11) designates the tubular shaft of the electromagnetic clutch (14) and the pulley (15). The tubular shaft (11) is fitted to the rotary shaft (16) of the tightening and feeding roller (13) so as to be movable in the axial direction so that a pin (18) projecting from the rotary shaft (16) is come to engage with a notched concave portion (19) with a slope (19') at the end of the tubular shaft (11). A spring holder (20) is fixed near the end of the rotary shaft (16) and a spring (21) is fitted between the spring holder (20) and the end surface of the tubular shaft (11).

($M_1$) designates a microswitch having a contact (22) which is come to contact with the rear surface of the electromagnetic clutch (14) when the clutch is moved. (23) designates an auxiliary roller in press-contact with the tightening and feeding roller (13). The auxiliary roller (23) is rotatably supported near the root of a lever (25) which is, in turn, pivotally supported, at the root, by a pin shaft (24) fixed to the machine frame. A pin (26) is fixed at the top of the lever (25) and a spring (29) is connected between the pin (26) and a pin (28) fixed on a bracket (27). The spring (29) acts to pull the lever (25) around the pin shaft (24) so that the auxiliary roller (23) is always pressed to the tightening and feeding roller (13). (30) designates a band guide for guiding a band between both the rollers (13), (23).

The reference numeral (2') designates a clutch device fitted to the output shaft of the reduction gear. A clutch disc (31'), fixed to the output shaft (2') of the reduction gear (2), has a large number of teeth meshing with a clutch pin (32) which is pivotally supported on a clutch housing (33) with a pin shaft (32') at the lower end. A spring (34) is fitted to the rear upper surface of the clutch pin (32) to push the clutch pin (32) so that the clutch pin is always meshed with the teeth (31') of the clutch disc (31).

On the top of the clutch pin (32), a projection (35) with a slope (35') is formed.

On the other hand, a clutch arm (38) is pivotally supported by the pin shaft (38') on the machine frame (not shown) so that the arm turns around the pin shaft (38') by exciting a solenoid (S). First and second retaining portions (37*a*), (37*b*) are respectively formed in the front surface of the clutch arm (38) with a predetermined distance so as to receive the projection (35) of the clutch pin (32). The retaining portions (37*a*), (37*b*) respectively have a slope (37'). The reference numeral (39) designates a tension spring.

Figure 4:
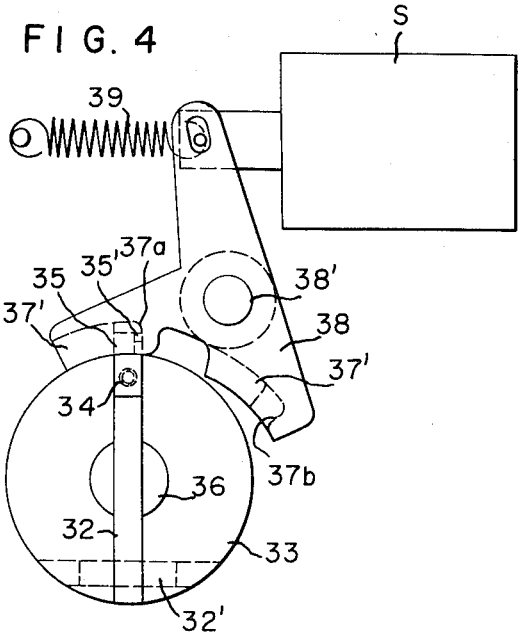
FIG. 4 is a front view of the clutch arm assembly.
Figure 5:
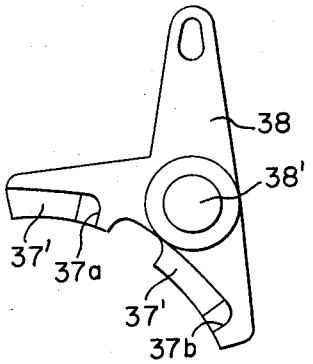
FIG. 5 is a front view of the clutch arm.
Figure 6:
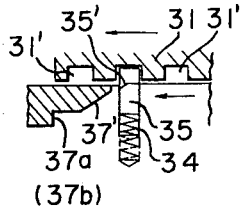
Figure 7:
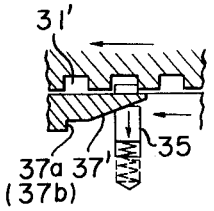
Figure 8:
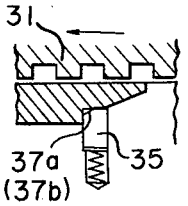

Operation of the clutch device (C) will be described. FIG. 4 illustrates the clutch device in a disconnected state in which the projection (35) of the clutch pin (32) is held in the first retaining portion (37*a*) and the clutch pin (32) is disconnected from the teeth (31') of the clutch disc (31).

When the solenoid (S) is actuated, the clutch arm is turned on the left side in the Figure around the pin shaft (38'). Thus, the projection (35) of the clutch pin (32) is disconnected from the first retaining portion (37*a*) and the spring (34) pushes the pin (32) to make turning the pin around the pin shaft (32') whereby the pin (32) is meshed with the teeth (31') of the clutch disc (31) into a clutch condition thereby rotating the cam shaft (36). When the clutch arm (38) turns, the outer circular surface of the clutch arm (38) is brought to contact with the outer surface of the clutch housing (33) to provide a condition that the projection (35) of the clutch pin (32) is ready to enter into the second retaining portion (37*b*). As the cam shaft (36) rotates in clutching, the slope (35') of the projection (35) of the clutch pin (32) approaches the slope (37') of the second retaining portion (37*b*) of the clutch arm (38) thus resulting in engagement of both the slopes (35'), (37'). With the engagement, the projection (35) is disconnected from the meshing teeth (31') of the clutch disc (31) against the spring (34) and then the projection (35) is brought to the state shown in FIG. 8 from that in FIG. 7; thus the projection is completely engaged with the second retaining portion (37*b*). That is, the clutch pin (32) is turned around the pin shaft (32') during the projection's engagement to provide a condition out of clutch.

Cams (42), (44) and (45) are fixed on the cam shaft (36) to respectively control the vertical movements of a rear gripper (46), a press bar (48) and a front gripper (49). A cam (43) is also fixed on the cam shaft to operate a heater (FIG. 1). The reference numeral (47) designates a spacer placed between the rear gripper (46) and the press bar (48). (50) designates a timing cam fixed at the end of the cam shaft (36) so that it is brought into contact with a pair of microswitches ($M_2$), ($M_4$), (51) and (52) respectively designate lower and upper guides; (53) (53) designate slide guides; (54) designates a slide table; (55) designates a switch lever with which the top end of an inserted band is come to contact; and (56) designates a switch pin moved by the switch lever to contact with a microswitch ($M_3$) at the outer end.

The operation of the strapping machine of the present invention will be described.

When the main switch of the electric circuit of the strapping machine is turned on, the contact (71*a*) of the relay (71) is turned on to drive the motor whereby the band is fed.

The band upwardly guided by the band guide (30) is passed onto the table through the upper surface of the tightening and feeding roller (13) and the lower surfaces of the lower guide (51) and the slide table (54). The band is again passed through the upper guide (52) onto the lower surface of the slide table (54) after turning around a package placed on the table. The top end of the band pushes the switch lever (55) placed on the lower surface of the table (54) and the switch lever (55) moves the switch pin (56), which actuates the microswitch ($M_3$) on the opposite side whereby the relay is actuated to close one contact ($72_{a1}$). As a result, the relay (73) is actuated. The actuation of the relay closes the contact (73*a*) and also open the contact (73*b*) of the switch S' to switch current passing through the coils of the motor. At the same time, the other contact ($72_{a2}$) of the relay (73) is also closed to excite the solenoid (S). Thus, actuation of the switch ($M_3$) causes rotation of the motor (M) causing the rotation of the reduction gear (2) through the means of the pulley (6), the belt (4) and the double pulley (3). Then, the clutch arm (38) is turned by the actuation of the solenoid (S) to cause disconnection of the projection (35) of the clutch pin (32) from the first retaining portion (37*a*), thus resulting in clutch engagement. Rotation of the cam shaft (36), i.e. cam (45) raises the front gripper (49) to grip the band in association with the slide table (54). The rotation of the cam shaft (36) is stopped by the projection (35) of the clutch pin (32) engaged with the second retaining portion (37*b*). At the same time, rotation of the timing cam (50) fixed at the end of the cam shaft (36) actuates the microswitch ($M_2$) to input the electromagnetic clutch (14) whereby the pulley to which the rotation of the motor (M) is transmitted through the small diametric pulley (3') of the double pulley (3) and the belt (5) rotates in synchronism with the electromagnetic clutch (14). The rotation of the pulley (15) causes rotation of the rotary shaft (16), hence the tightening and feeding roller rotates so that the band is pulled back in association with the auxiliary roller (23) in press-contact with the tightening and feeding roller.

The pulling-back operation provides the tightening of the band wound around the package. When the band is tightened, that is, load is applied to the tightening and feeding roller (13), thrust force produced between the slant side (19') of the concave portion (19) of the tubular shaft (11) as a power transmitting part and the pin (18) becomes superior to the spring action of the spring (21) whereby the tubular shaft (11) is moved outwards. That is, the pin (18) travels along the slant side (19') of the concave portion (19) and finally stops on a short side (19'') which is in parallel to the center line of the concave portion. In this case, the rear surface of the electromagnetic clutch (14) on the tubular shaft (11) is in contact with the contact (22) of the microswitch ($M_1$) for actuation. When the microswitch is actuated, the solenoid is energized to return the clutch arm (38) to the original positions by the action of the spring (39) whereby the projection (35) of the clutch pin (32) is disconnected from the second retaining portion (37*b*) to connect the clutch thereby initiating the rotation of the cam shaft again. The rotation of the cam shaft raises the rear gripper (46) to grip the band. As soon as the gripping of the band is completed, the electromagnetic clutch (14) is deactuated by the input signal of the microswitch ($M_2$) produced by the rotation of the timing cam (50). In this time, a heater (62) is inserted between the upper and lower surfaces of tha band, which is looped around the package and is superimposed by the operation of the cam (43) to melt-bond them. As soon as the heater (62) is removed by the rotation of the cam (43), the cam (44) operates the press bar (48) to press and cut the band. After cutting the band, the projection (35) of the clutch pin (32) engages again with the first retaining portion (37*a*) to stop the rotation of the cam shaft (36). Just before the stopping of the cam shaft, the timing cam (50) makes the microswitch ($M_4$) active so as to open the break contact (74*b*) thereby actuating the relays (72), (73). Accordingly, the electromagnetic clutch (14) is reinput so that the pulley (15) is connected to the electromagnetic clutch. Instantaneously, the switch (S') of the motor is switched to feed current from the coil ($C_1$) to ($C_2$). A large start motive force is produced in the coil ($C_2$) by current from the capacitor ($C_0$) having a large capacitance to make the motor reversely rotate whereby the band is fed through the tightening and feeding roller (13) and the auxiliary roller in press-contact therewith.

In the strapping machine of the present invention, an instantaneously reversible type motor which has a very simple structure and operates on single phase a.c. is used. This allows one to use only one tightening and feeding roller whereby the structure can be as a whole simplified. As the motor has the main and auxiliary coils having the same diameter and number of turns of the wires each other, when the switch is operated to make the motor reversely rotate, problems of burning of the coils caused by a circulating current, melt-bonding of the switch contact are eliminated. Durability of the coils is satisfactory even though the motor is frequently switched. A large start motive force can be obtained by using a capacitor having a large capacitance. It is unnecessary to use an electromagnetic brake used in the conventional machine whereby the total structure can be simplified.

The pulley (15) is provided to be movable with the electromagnetic clutch (14) when a tightening force is detected. That is, the pulley (15) is moved with respect to the small diameter pulley (8') of the double pulley (3). However, no problem occurs concerning a force transmitting function because the movement of the pulley (15) is linear and is substantially parallel and the belt (5) wound between both the pulleys is not too tight.

In the embodiment of the present invention, a tightening force detector is placed on the tightening and feeding roller. It is, however, not critical to place it on the roller but can be on another tightening roller.

A tightening force detector is also placed on the electromagnetic clutch to detect a tightening load so that a microswitch is actuated. The microswitch, in turn, actuates the clutch mechanism so as to perform the subsequent operations described above. The structure is simple and can precisely control the subsequent operations. Wearing of the microswitch contact in contact with the electromagnetic clutch can be prevented because the clutch is not rotated in non-operating time.

The clutch mechanism is operated by turning the clutch arm (38) of the solenoid (S) to connect or disconnect the projection (35) of the clutch pin (32) with the first or second retaining portions whereby the clutch pin (32) is turned around the pin shaft (32') against the spring (34) so as to engage with or disengage from the meshing teeth (31') of the clutch disc (31). The structure is simple and reliable in a long term use. In the clutch mechanism of the present invention, the cam shaft can be quickly stopped at a correct position without causing positional shift and accordingly, operations of many parts for heat-bonding the band can be precisely performed and the clutch mechanism can be fabricated at a low price because of a simple structure.

As described above, in accordance with the strapping machine of the present invention, feeding and tightening of a band is performed by two simple rollers: a tightening and feeding roller rotated by a motor capable of the instantaneous change of normal and reverse rotations and an auxiliary roller in press-contact with the roller; engagement and disengagement of a clutch device placed between a reduction gear and a cam shaft is performed by turning the clutch arm of the clutch device by a solenoid; a pin formed on the shaft of the tightening and feeding roller is engaged with a notched concave portion formed in the tubular shaft of the electromagnetic clutch to detect a band tightening force whereby engagement and disengagement of the clutch device is mechanically related to the detection of a band tightening force detecting means, thus, a band strapping operation is smoothly and efficiently carried out by the totally simple structure.

We claim:

1. A band type strapping machine comprising a feeding and tightening roller driven by a motor, an auxiliary roller in contact with the feeding and tightening roller, a cam shaft which is rotated by said motor through a reduction gear and a clutch mechanism and which has cams for respectively actuating a rear gripper, a heater, a press bar and a front gripper, an improvement characterized in that said motor is capble of instantaneous change of normal and reverse rotations and has a large starting torque and an electromagnetic clutch is fitted to the rotary shaft of said tightening and feeding roller so as to be movable in the axial direction depending upon increase of a band tightening force whereby detection of the tightening force caused by the movement of said electromagnetic clutch is mechanically related to the engagement or disengagement of said clutch mechanism.

2. A band type strapping machine according to claim 1 wherein said clutch mechanism is controlled by a microswitch ($M_1$) in contact with said electromagnetic clutch.

3. A band type strapping machine according to claim 1 wherein a pin is formed on said rotary shaft (16) to engage with a notched concave portion of the tubular shaft of said electromagnetic clutch.

4. A band type strapping machine according to claim 1 wherein said clutch mechanism comprises a clutch arm turned by a solenoid to connect with or disconnect from a clutch pin.

5. A band type strapping machine according to claim 1 wherein the operation of said electromagnetic clutch is controlled by actuating microswitches ($M_2$), ($M_4$) by the operation of a timing cam fixed to said cam shaft.

* * * * *